US005269406A

United States Patent [19]

Olsen et al.

[11] Patent Number: 5,269,406

[45] Date of Patent: Dec. 14, 1993

[54] CARRIER STOCK HAVING TEAR-OPEN TABS ARRANGED IN CLUSTERS

[75] Inventors: Robeert Olsen, Medinah; Mike Binsfeld, Chicago; William Weaver, Northbrook, all of Ill.

[73] Assignee: Illinois Tool Works Inc, Glenview, Ill.

[21] Appl. No.: 21,126

[22] Filed: Feb. 23, 1993

[51] Int. Cl.[5] ..... B65D 71/00

[52] U.S. Cl. ..... 206/150; 206/151; 206/161; 294/87.2

[58] Field of Search ..... 206/150, 151, 158, 161; 294/87.2

[56] References Cited

U.S. PATENT DOCUMENTS

| | | | |
|---|---|---|---|
| 2,997,169 | 8/1961 | Poupitch | 206/150 |
| 3,325,004 | 6/1967 | Wanderer | 206/150 |
| 3,733,100 | 5/1973 | Tanzer | 294/87.2 |
| 4,033,457 | 7/1977 | Weaver | 206/150 X |
| 4,064,989 | 12/1977 | Olsen . | |
| 4,557,375 | 12/1985 | Weaver et al. . | |
| 4,782,955 | 11/1988 | Weaver et al. | 206/161 |
| 5,020,661 | 6/1991 | Marco . | |
| 5,139,137 | 8/1992 | Marco . | |

*Primary Examiner*—Bryon P. Gehman

*Attorney, Agent, or Firm*—Dressler, Goldsmith, Shore & Milnamow, Ltd.

[57] ABSTRACT

Carrier stock is disclosed, which has band segments defining container-receiving apertures and defining integral handles, along with tear-open tabs arranged in four-tab clusters. Each cluster includes two tabs proximate to each other and connected by a single, frangible bridge, respectively on opposite sides of the transverse midline of a generally transverse band segment. Each cluster includes two tabs proximate to each other and connected by a single, frangible bridge, respectively on opposite sides of the longitudinal midline of a generally longitudinal band segment. Each tab extends from one of the band segments, outwardly from one of the container-receiving apertures. Each tab and the band segment with such tab are slitted to define a series of frangible bridges between an additional aperture bounded partly by such tab and a container-receiving aperture. A package comprising containers and a carrier severed from such stock is disclosed.

7 Claims, 1 Drawing Sheet

CARRIER STOCK HAVING TEAR-OPEN TABS ARRANGED IN CLUSTERS

TECHNICAL FIELD OF THE INVENTION

This invention pertains to carrier stock for machine application to substantially identical containers. This invention pertains, more particularly, to carrier stock having tear-open tabs arranged in clusters.

BACKGROUND OF THE INVENTION

Typically, carrier stock for machine application to substantially identical containers, such as cans or bottles, is formed, as by die-cutting, from a single sheet of resilient polymeric material. Such stock is formed with band segments defining container-receiving apertures to receive the individual containers. Such stock is severable to form individual carriers.

As exemplified in Weaver et al. U.S. Pat. No. 4,557,375, it is known to form such stock with band segments defining integral handles, which are disposed within container-receiving apertures when such stock is unstressed. As exemplified therein, the band segments defining the integral handles are connected to other band segments by frangible bridges, which are broken when the carrier stock is applied to the containers.

As exemplified in Marco U.S. Pat. No. 5,020,661, it is known to form such stock with tear-open tabs, which extend from certain of the band segments defining the container-receiving apertures. As exemplified therein, each tear-open tab extends from one of the band segments into one of the container-receiving apertures when the carrier stock is unstressed. If an attempt were made to provide the carrier stock disclosed therein with band segments defining integral handles that were disposed within container-receiving apertures, as exemplified in the Weaver et al. patent noted above, the tear-open tabs would interfere with the integral handles.

There has been a need, to which this invention is addressed, for carrier stock formed with tear-open tabs that would not interfere with machine application of such stock and that would permit such stock to be also formed with band segments defining integral handles, which would be disposed within container-receiving apertures when such stock was unstressed.

SUMMARY OF THE INVENTION

This invention provides carrier stock for machine application to substantially identical containers. Although carrier stock according to this invention has particular utility where the containers are bottles, such as blow-molded bottles for beverages, carrier stock according to this invention has additional utility where other containers are used, such as beverage cans.

The carrier stock is made from a single sheet of resilient polymeric material. The carrier stock has band segments defining container-receiving apertures arranged in longitudinal rows and transverse ranks to receive the individual containers. The band segments defining the container-receiving apertures include generally longitudinal band segments and generally transverse band segments. The carrier stock has tear-open tabs.

According to this invention, each tear-open tab extends from an associated one of the band segments defining an associated one of the container-receiving apertures. Significantly, each tear-open tab extends away from the associated aperture.

Since selected ones of the generally transverse band segments have transverse midlines, along which the carrier stock is severable to form individual carriers, the tear-open tabs may be advantageously arranged in clusters. The tear-open tabs of each cluster may include two tear-open tabs on each side of such a transverse midline.

The generally longitudinal band segments between the longitudinal rows of the container-receiving apertures have longitudinal midlines. The tear-open tabs of each cluster may include two tear-open tabs on each side of such a longitudinal midline.

In a preferred arrangement, the tear-open tabs are arranged in four-tab clusters. Thus, each four-tab cluster includes two tear-open tabs disposed on each side of such a transverse midline. Also, each four-tab cluster includes two tear-open tabs disposed on each side of such a longitudinal midline.

Preferably, the tear-open tabs of each cluster are connected to one another. Thus, at least one frangible bridge may connect the tear-open tabs on each side of such a transverse midline. Also, at least one frangible bridge may connect the tear-open tabs on each side of such a longitudinal midline.

Advantageously, this invention permits the carrier stock also to include at least one integrally joined band segment defining an integral handle, which is disposed within a selected one of the container-receiving apertures when the carrier stock is unstressed. Furthermore, this invention permits the band segments defining the container-receiving aperture that defines each handle also to include one of the tear-open tabs. The carrier stock may have integral handles in two diagonally opposed container-receiving apertures.

Additionally, this invention provides a novel package comprising substantially identical containers in a generally rectangular array and a carrier, which is one of the carriers formed when the carrier stock is severed along the transverse midlines noted above.

These and other objects, features, and advantages of this invention are evident from the following description of embodiments of this invention with reference to the accompanying drawings.

DETAILED DESCRIPTION OF ILLUSTRATED EMBODIMENTS

Figures 1, 2, 3, 4:
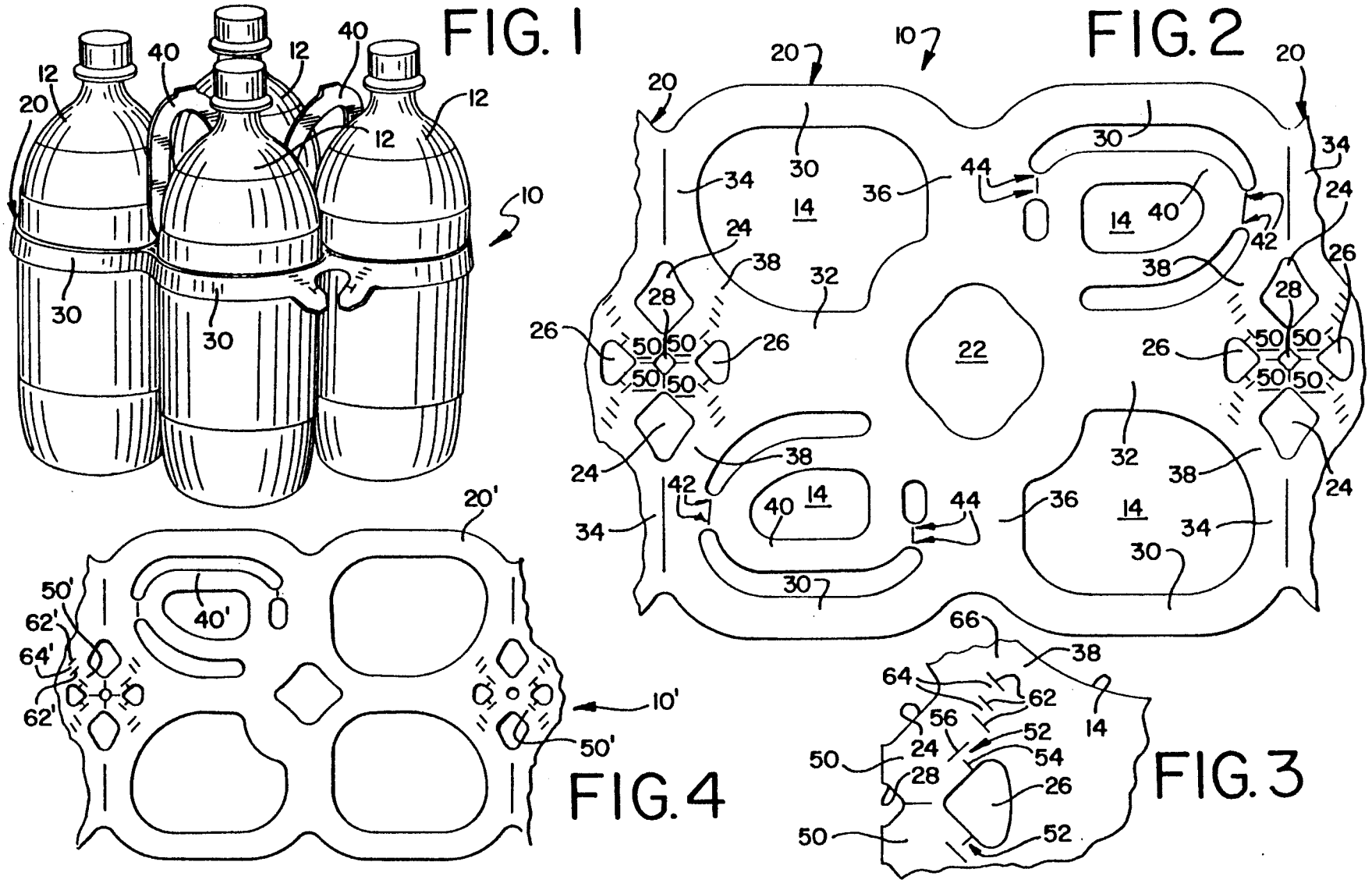
FIG. 1 is a perspective view of a novel package comprising four blow-molded bottles and a carrier, which is formed from carrier stock according to a preferred embodiment of this invention.
FIG. 2, on a larger scale, is a fragmentary plan of carrier stock according to the preferred embodiment noted above.
FIG. 3 is an enlarged, fragmentary detail taken from FIG. 2.
FIG. 4, on a smaller scale compared to FIG. 2, is a fragmentary plan of carrier stock according to an alternative embodiment of this invention.

As shown in FIGS. 1 and 2, carrier stock 10 for machine application to substantially identical containers 12 constitutes a preferred embodiment of this invention. Such stock 10 is formed with separate apertures 14 to receive the individual containers 12. The carrier stock 10 is severable along transverse lines to form substantially identical carriers 20, one of which is shown fully.

In FIG. 1, a package is shown, which comprises four such containers 12 and one such carrier 20, as severed from such stock 10. In FIG. 2, the carrier stock 10 is shown in an unstressed condition.

As shown in FIG. 1, the containers 12 are blow-molded bottles of a type used commonly for soft drinks. Typically, such a bottle has a capacity of two liters, exclusive of head space. This invention is not limited, however, to usage with such bottles but is useful with cans, bottles, and other containers of various kinds. The carrier stock 10 is applied so as to grip the containers 12 at their side walls 16.

The carrier stock 10 is formed in an indeterminate length, as by die-cutting, from a single sheet of resilient polymeric material. A preferred material is low density polyethylene. A preferred thickness for such stock 10 in an unstressed condition, if low density polyethylene is used, is about 16 mils.

The carrier stock 10 is formed, for each individual carrier 20, with integrally joined band segments defining four container-receiving apertures 14 and one generally centered aperture 22 eliminating excess material. As shown in FIG. 2, such apertures 14 are arranged in a generally rectangular array with longitudinal rows and transverse ranks, namely two longitudinal rows and three transverse ranks for each individual carrier 20. The carrier stock 10 also is formed, for reasons to be later explained, with additional apertures 24, 26, 28.

The band segments defining the apertures 14 include relatively narrow, generally longitudinal band segments 30 at outer edges of the carrier stock 10 and each individual carrier 20, relatively wide, generally longitudinal band segments 32 between the longitudinal rows of the apertures 14, generally transverse band segments 34 defining transverse midlines, along which the carrier stock 10 is slitted, as shown, and along which the carrier stock 10 is severable to form the individual carriers 20, and relatively wide, generally transverse band segments 36 between the transverse ranks of the apertures 14. As shown in FIG. 2, the band segments defining the apertures 14 also include curved band segments 38 joining the band segments 32 to the band segments 34, on each side of the transverse midline of each of the band segments 34. The generally longitudinal band segments 32 define a longitudinal midline.

When the carrier stock 10 is applied to the containers 12, the carrier stock 10 is forced downwardly along the side walls 16 of the containers 12. Thus, as shown in FIG. 1, the band segments 30 are turned downwardly. Moreover, the band segments 34, 36, are folded into generally U-shaped configurations, which open upwardly.

The carrier stock 10 also is formed, for each individual carrier 20, with integrally joined band segments defining two integral handles 40 near diagonally opposite corners of the carrier 20. Each handle 40 is disposed within one of the apertures 14 when the carrier stock 10 is unstressed. The band segments defining each handle 40 are joined to one of the band segments 34, by two frangible bridges 42, and to one of the band segments 36, by two frangible bridges 44. The carrier stock 10 is slitted to form the frangible bridges 42, 44, which break when the carrier stock 10 is applied. The integral handles 40 are folded upwardly, as shown in FIG. 1, when the carrier stock 10 is applied.

The carrier stock 10 is formed with tear-open tabs 50 in four-tab clusters. Each tear-tab 50 extends from one of the curved band segments 38 and is positioned between longitudinal and transverse band segments 32, 34, and at acute angles relative to the longitudinal and transverse midlines noted above. Each tear-open tab 50 extends away from one of the apertures 14, namely the aperture 14 defined by such band segment 38 and by other band segments. Each cluster is comprised of four tear-open tabs 50, which are proximate to one another, and which are formed so as to be generally symmetrical in a rotational sense. In each cluster of four tear-open tabs 50, two tear-open tabs 50 are disposed on each side of the transverse midline defined by the band segments 34 on opposite sides of such cluster, and two tear-open tabs 50 are disposed on each side of the longitudinal midline defined by the band segments 32. The location and angular disposition of the tab 50 contributes to the tab 50 becoming angularly disposed to the surface of the container 12, as shown in FIG. 1. This spacing facilitates the gripping of the tab 50 by the consumer.

As shown in FIG. 2, each tear-open tab 50 partly bounds an aperture 24, which is bisected by the transverse midlines defined by the band segments 34 on opposite sides of the cluster comprising such tab 50. Moreover, each tear-open tab 50 partly bounds an aperture 26, which is bisected by the longitudinal midline defined by the band segments 32. Furthermore, each tear-open tab 50 partly bounds an aperture 28, which is bisected by the transverse midlines defined by the band segments 34 on opposite sides of the cluster comprising such tab 50 and by the longitudinal midline defined by the band segments 32. An aperture 28 is centered among the tear-open tabs 50 of each cluster.

Moreover, in each cluster, the carrier stock 10 is slitted from the aperture 28 centered among the tear-open tabs 50 of such cluster so as to define frangible bridges 52 connecting each tear-open tab 50 to two such tabs 50. Thus, on each side of each tear-open tab 50, a single frangible bridge 52 connects such tab 50 to another such tab 50.

Furthermore, each tear-open tab 50 and the band segment 38 from which such tab 50 extends are slitted to define a series of frangible bridges between an associated aperture 26, which is bounded partly by such tab 50, and an associated aperture 14, which is bounded partly by such segment 38.

As indicated in FIG. 3, a first slit 54 extends from the associated aperture 26 into such tab 50, which has a second slit 56 normal to the first slit 54 and spaced from the first slit 54 by a frangible bridge 58. Moreover, the second slit 56 is spaced by a frangible bridge 60 from three parallel slits 62, which are parallel to the first slit 54. These parallel slits 62 are staggered, as shown, and are spaced from one another by frangible bridges 64 and from the associated aperture 14 by a frangible bridge 66. These slits and frangible bridges permit such tab 50 and the band segment 38 from which such tab 50 and the band segment 38 from which such tab 50 extends to be readily torn, so as to release a container 12 from the associated aperture, while leaving such tab 50 on the carrier 20.

Whenever it is described above that the carrier stock 10 or parts of the carrier stock 10 are slitted, such stock 10 or parts may be so slitted by scorings, which are not cut entirely through the carrier stock 10, by slits cut entirely therethrough, or by plural perforations.

In FIG. 3, in which primed reference numbers refer to elements similar to elements referenced by similar, unprimed reference numbers in FIGS. 1 and 2, carrier stock 10′ is shown, which constitutes an alternative embodiment of this invention. The carrier stock 10' is similar to the carrier stock 10, except that the carrier stock 10' is formed with a single handle 40' for each carrier 20', and except that each tear-open tab 50' and the curved band segment 38' from which such tab 50' extends have one fewer slit 62' and one fewer frangible bridge 64'.

A carrier 20 formed from the carrier stock 10 according to the preferred embodiment described above is suitable for larger, heavier containers, such as two-liter or half-gallon bottles. A carrier 20' formed from the carrier is suitable for smaller, lighter containers, such as half-liter or one-pint bottles.

In either embodiment described above, the location of the clusters of tabs generally along the longitudinal centerline of the carrier stock facilitates the winding of the carrier stock, since the additional material in that region tends to create a bridge or track on which the carrier stock is wound. The securement of the tabs to each other also eliminates snagging or entanglement of the tabs during the winding process.

Preferably, in either embodiment described above, the carrier stock has two longitudinal rows of container-receiving apertures. Alternatively, subject to weight constraints, the carrier stock could have three or more longitudinal rows of such apertures.

Various modifications may be made in the embodiments described above without departing from the scope and spirit of this invention.

We claim:

1. Carrier stock for machine application to substantially identical containers, said carrier stock being made from a single sheet of resilient polymeric material, said carrier stock having integrally joined band segments defining container-receiving apertures arranged in longitudinal rows and transverse ranks to receive the individual containers, the band segments including generally longitudinally band segments and generally transverse band segments said carrier stock having tear-open tabs, each tear-open tab extending from an associated one of the band segments defining an associated one of the container-receiving apertures wherein selected ones of the generally transverse band segments define transverse midlines, along which said stock is severable to form individual, identical carriers, the end-most transverse rank of apertures in each individual carrier includes said tear-open tabs which extend away from the associated aperture creating radially extending clusters of tear tabs adjacent the transverse midlines, the tear-open tabs of each cluster include two tear-open tabs on each side of such a transverse midline.

2. The carrier stock of claim 1 wherein selected ones of the generally transverse band segments have transverse midlines, wherein the generally longitudinal band segments between the longitudinal rows of the container-receiving apertures have longitudinal midlines, wherein the tear-open tabs are arranged in four-tab clusters, wherein the tear-open tabs of each cluster include two tear-open tabs respectively on each side of such a longitudinal midline, and wherein the tear-open tabs of each cluster include two tear-open tabs respectively on each side of such a transverse midline.

3. The carrier stock of claim 1 wherein the generally longitudinal band segments between the longitudinal rows of the container-receiving apertures have longitudinal midlines, wherein the tear-open tabs are arranged in clusters, and wherein the tear-open tabs of each cluster include two tear-open tabs on each side of such a longitudinal midline.

4. The carrier stock of claim 3 wherein the tear-open tabs of each cluster are connected to one another by frangible bridges.

5. The carrier stock of claim 1 having at least one integrally joined band segment defining an integral handle, which is disposed within a selected one of the container-receiving apertures when said carrier stock is unstressed.

6. The carrier stock of claim 5 wherein the band segments defining the container-receiving aperture that includes the integral handle also include one of the tear-open tabs.

7. The carrier stock of claim 5 having integral handles in two diagonally opposed container-receiving apertures.

* * * * *

UNITED STATES PATENT AND TRADEMARK OFFICE

CERTIFICATE OF CORRECTION

PATENT NO. : 5,269,406

DATED : December 14, 1993

INVENTOR(S) : Robert Olsen, Mike Binsfeld & William Weaver

It is certified that error appears in the above-indentified patent and that said Letters Patent is hereby corrected as shown below:

Col. 4, line 55, "and the" after "50" should be deleted

Col. 4, line 56, "band segment 38 from which such tab 50" should be deleted

Claim 1, Col. 5, line 38, "longitudinally" should be --longitudinal--.

Signed and Sealed this

Seventeenth Day of May, 1994

Bruce Lehman

*Attest:*

BRUCE LEHMAN

*Attesting Officer*

*Commissioner of Patents and Trademarks*